US010443831B2

(12) United States Patent
Webb

(10) Patent No.: US 10,443,831 B2
(45) **Date of Patent: *Oct. 15, 2019**

(54) LED STRIP CONNECTOR SYSTEM

(71) Applicant: MARKLYN GROUP INC., Brampton (CA)

(72) Inventor: Blair Webb, Brampton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/383,763

(22) Filed: Apr. 15, 2019

(65) Prior Publication Data

US 2019/0242564 A1 Aug. 8, 2019

Related U.S. Application Data

(63) Continuation of application No. 15/665,194, filed on Jul. 31, 2017, now Pat. No. 10,309,634.

(51) Int. Cl.

| | |
|---|---|
| ***F21V 23/06*** | (2006.01) |
| ***H01R 13/627*** | (2006.01) |
| ***F21S 43/14*** | (2018.01) |
| ***F21V 21/005*** | (2006.01) |
| ***F21V 15/015*** | (2006.01) |
| ***F21V 31/00*** | (2006.01) |
| ***H01R 13/52*** | (2006.01) |
| ***F21S 45/00*** | (2018.01) |
| ***F21S 43/15*** | (2018.01) |
| ***F21V 17/16*** | (2006.01) |
| *F21Y 115/10* | (2016.01) |
| *F21Y 103/10* | (2016.01) |

(52) U.S. Cl.

CPC ..... *F21V 23/06* (2013.01); *F21S 43/14* (2018.01); *F21S 43/15* (2018.01); *F21S 45/00* (2018.01); *F21V 15/015* (2013.01); *F21V 17/164* (2013.01); *F21V 21/005* (2013.01); *F21V 31/005* (2013.01); *H01R 13/5219* (2013.01); *H01R 13/6272* (2013.01); *F21Y 2103/10* (2016.08); *F21Y 2115/10* (2016.08)

(58) Field of Classification Search

CPC ..... F21V 23/06; F21V 43/15; F21V 21/005; F21V 15/015; F21V 31/0005; F21S 43/15; F21S 45/00; H01R 13/5219; H01R 13/6272; F21Y 2103/10; F21Y 2115/10

See application file for complete search history.

(56) References Cited

U.S. PATENT DOCUMENTS 10,309,634 B2 * 6/2019 Webb ..... F21V 23/06

* cited by examiner

*Primary Examiner* — David V Bruce

(57) ABSTRACT

An LED strip connector system for providing secure electrical and mechanical connection between LED strips comprising a male socket end, a female socket end, a locking mechanism, a gasket, a wired housing, and an end cap. The locking mechanism consists of a clip and clip catch and provides a detachable, secure, vibration-resistant mechanical connection between strips. The gasket is made of an elastic, impermeable material and is configured and positioned to establish a moisture-resistant seal between connectors, protecting the electrical connection from environmental moisture. The wired housing connects a female socket end to a power cord. The end cap protects the exposed contacts of an open socket.

19 Claims, 10 Drawing Sheets

LED STRIP CONNECTOR SYSTEM

CROSS REFERENCE TO RELATED APPLICATION

This application is a Continuation Application of U.S. application Ser. No. 15/665,194, filed Jul. 31, 2017, entitled LED STRIP CONNECTOR SYSTEM the contents of which are incorporated herein by reference.

TECHNICAL FIELD

The present invention relates to electronic connectors.

BACKGROUND

Flexible, mountable, extendable strips of light emitting diodes (LEDs) of various colors, available off-the-shelf, are used in, among other applications, ornamenting or illuminating the interiors or exteriors of vehicles including but not limited to cars, boats, motorcycles, etc. Such applications can expose said LED strips to adverse conditions including significant sustained vibration and exposure to moisture. LED strips joined by non-locking connectors to other LED strips are thus vulnerable to vibration-induced detachment in vehicle use. Further, LED strips are powered via electrical contacts located at the connections between strips. Exposing these electrical connections to moisture poses a risk of electrical short-circuiting which would adversely affect the successful operation and health of the LED strips. What is desired is an apparatus for connecting LED strips that is both vibration- and moisture-resistant. The present invention provides such an apparatus.

SUMMARY

An objective of the invention is to provide mechanical and electrical connection between light emitting diode (LED) strips and LED strips and power cords.

Another objective of the present invention is to mitigate vibration-induced detachment of two connected LED and/or power strips.

A further objective of the present invention is to mitigate moisture-induced electrical shorting of the electrical contacts between connected LED strips and/or power strips.

To fulfill the above mentioned objectives, according to one embodiment of the present invention, a connector system for connecting two strips, LED and/or power, consists of a male socket comprising a dielectric housing defining a front end as facing a female socket, a rear face opposite the front face, upper and lower surfaces between said front and rear faces, a male connection interface consisting of four conductive prongs extending from a shaped extrusion, said shaped extrusion extending from said front face, and having said rear face attached or incorporated into an LED strip or power supply; a female socket comprising a dielectric housing defining a front face as facing said male socket, a rear face opposite said front face, upper and lower surfaces between said front and rear faces, a female connection interface located on said front face configured to receive said male connection interface, and having said rear face attached or incorporated into an LED strip or end cap; the male socket having on its upper surface a clip catch; the female socket having on its upper surface an inclined clip arm attached via a clip pivot point to said upper surface; a gasket preferably of rubber or other suitable elastomer seated at the base of said shaped extrusion of said male socket, said gasket being held in place by a pair of lock grooves thereby forming a continuous impermeable seal between said male and female sockets when such are joined; a wired housing comprising a forward section configured to receive a male socket, said male socket being oriented such that said male socket connection interface is facing outward and being tightly seated or fixed in place by, e.g., an adhesive such that electrical connections within said wired housing are not exposed to the environment, said wired housing further comprising a rearward section having an opening whereby wires supplying electrical power can be admitted to the interior of said wired housing and connected to the rear face of said male socket, said rearward opening being narrower than said forward opening, said forward section transitioning to said rearward section at an intermediate point along the longitudinal axis of said wired housing, and said rearward section being smoothly tapered from said intermediate point to said narrow rearward opening; and an end cap configured to be received by a female socket such that the electrical contacts of said female socket are not exposed to the environment. To those skilled in the art to which this invention relates, many changes in construction and widely different embodiments and applications of the invention will suggest themselves without departing from the scope of the invention as defined herein. The disclosures and the descriptions herein are purely illustrative and are not intended to be in any sense limiting.

BRIEF DESCRIPTION OF THE DRAWINGS

For a better understanding of the present invention including the features, advantages and specific embodiments, reference is made to the following detailed description along with accompanying Figures, in which.

DETAILED DESCRIPTION

While the making and using of the disclosed embodiments of the present invention is discussed in detail below, it should be appreciated that the present invention provides many applicable inventive concepts which can be embodied in a wide variety of specific contexts. some features of the preferred embodiments shown and discussed may be simplified or exaggerated for illustrating the principles of the invention.

Reference will now be made in detail to the preferred embodiment of the present invention.

Figure 1:
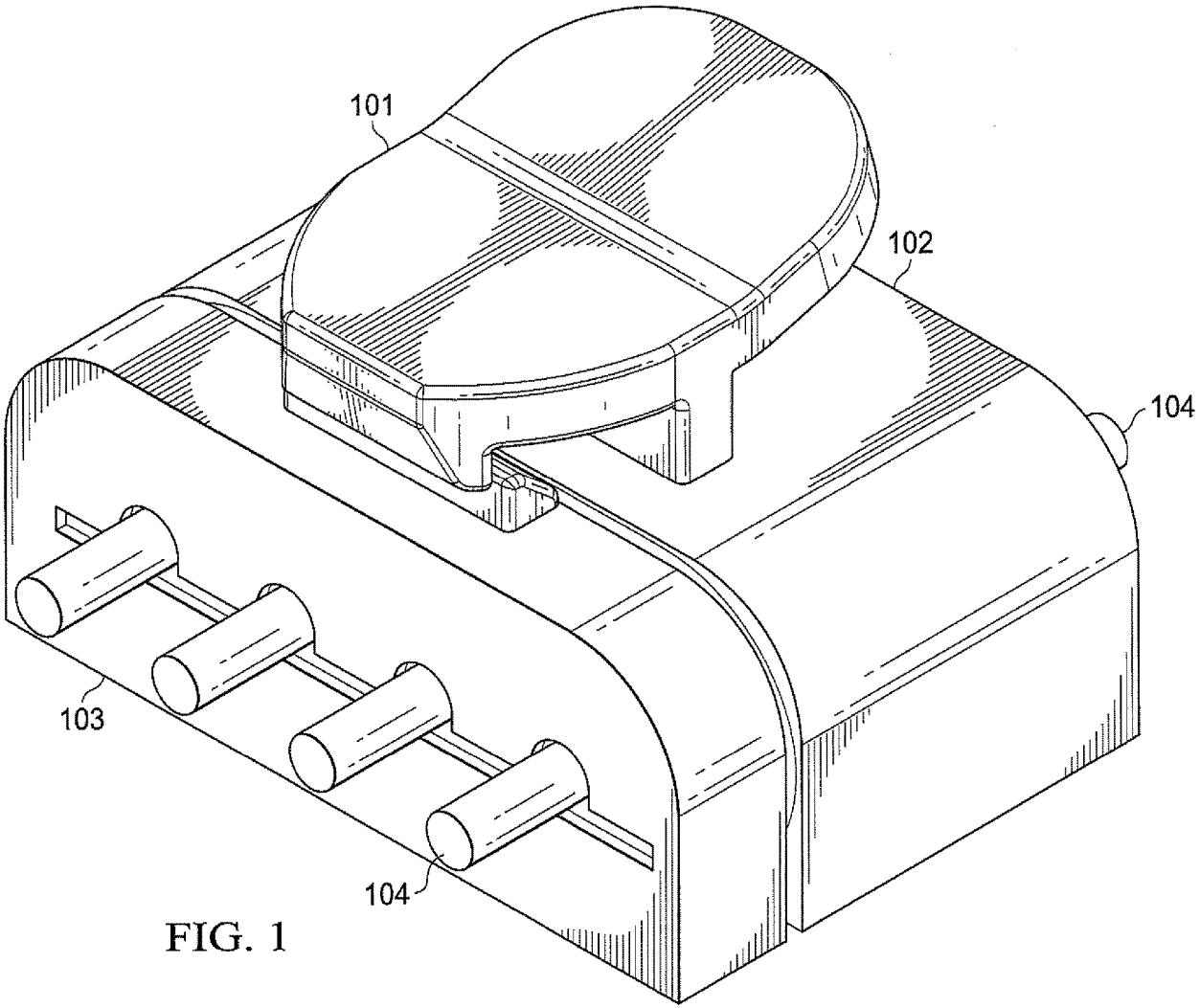
FIG. 1 is a perspective view of a strip connector in accordance with the present invention in a connected configuration.
Figure 9:
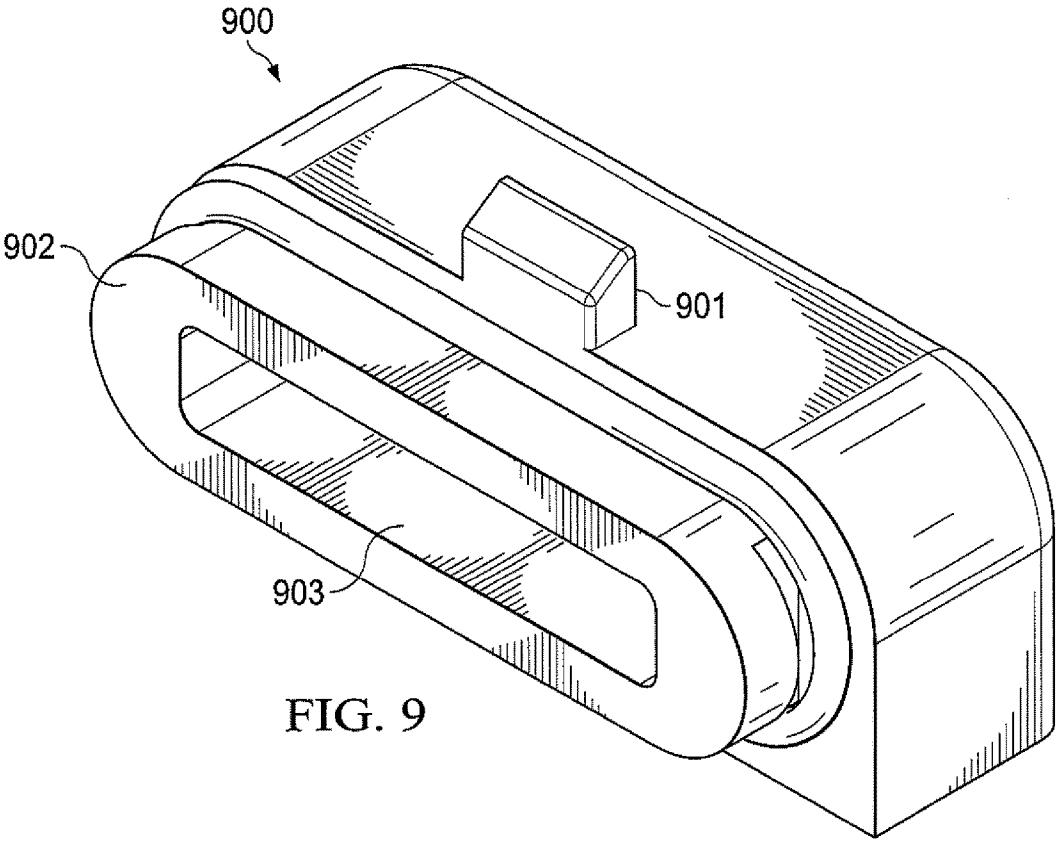
FIG. 9 is a front perspective view of an end cap in accordance with the present invention and a seated gasket in accordance with the present invention.
Figure 11:
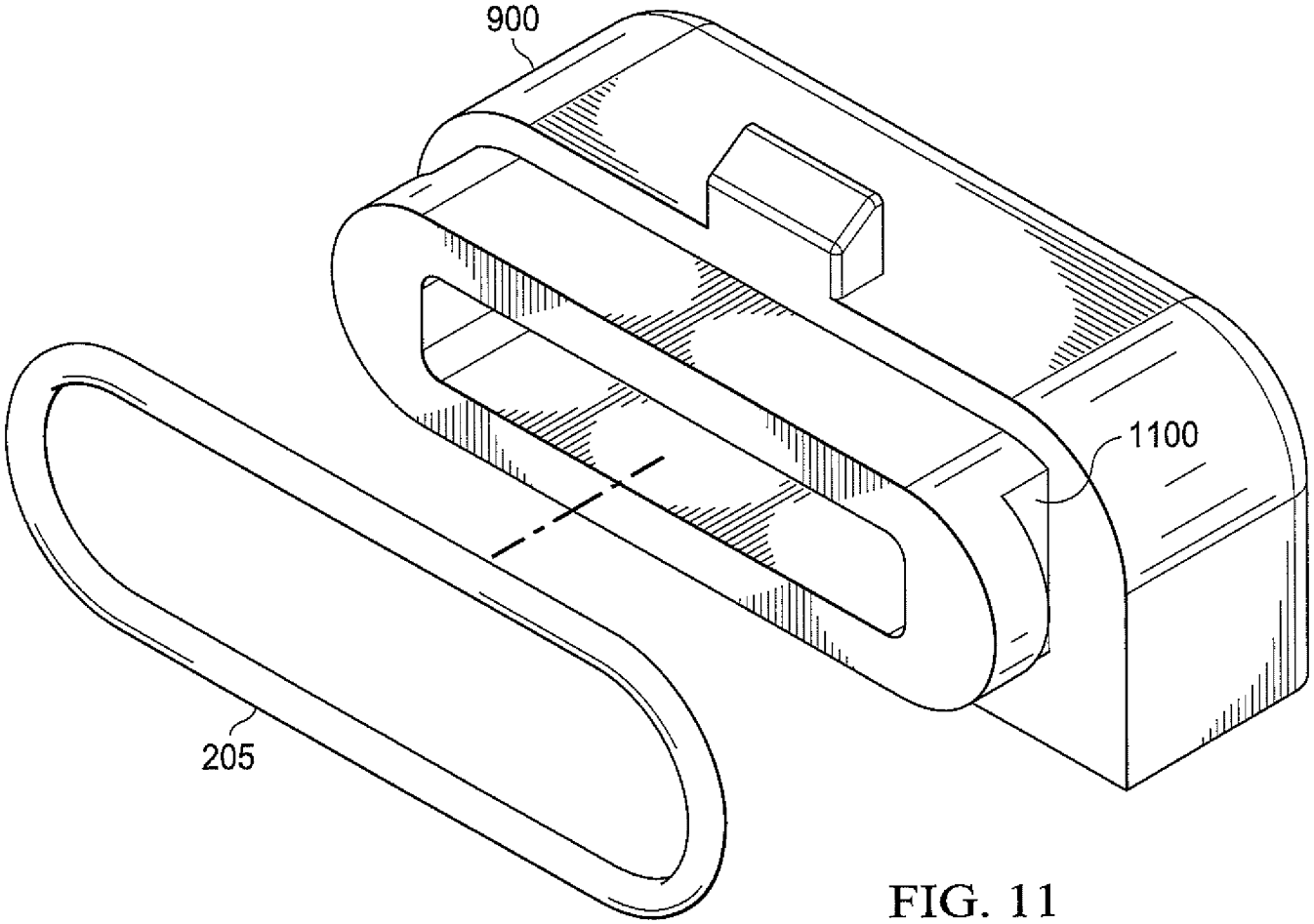
FIG. 11 is a front perspective view of an end cap in accordance with the present invention and an associated gasket in accordance with the present invention in a separated configuration/state.

Referring to FIG. 1, an LED strip connector system in accordance with the present invention for connecting two LED strips (not shown) generally comprises a male socket 103, a female socket 102, a locking mechanism 101, a gasket 205 (FIG. 2), a wired housing 700 (FIG. 7), and an end cap 900 (FIG. 9). In the preferred embodiment said male socket 103 comprises an insulated or dielectric housing defining a male front face 503 as facing said female socket 102, a male rear face 401 opposite said male front face 503, and a male upper surface 402 and male lower surface 501 between said male front and rear faces, the remaining faces being male lateral faces 403A and 403B. Further, said female socket 102 comprises an insulated or dielectric housing defining a female front face 406 as facing said male socket 103, a female rear face 504 opposite said female front face 406, and a female upper surface 407 and female lower surface 502 between said female front and rear faces, the remaining faces being female lateral faces 412A and 412B. Additionally, said locking mechanism 101 comprises a clip catch 204 extending from the upper surface 402 of the male socket 103, a clip pivot point 202 extending from the upper surface 407 of the female socket 102, a clip arm 201 attached to the clip pivot point 202, said clip arm 201 having at a terminal end a clip arm lip 203.

Figure 4:
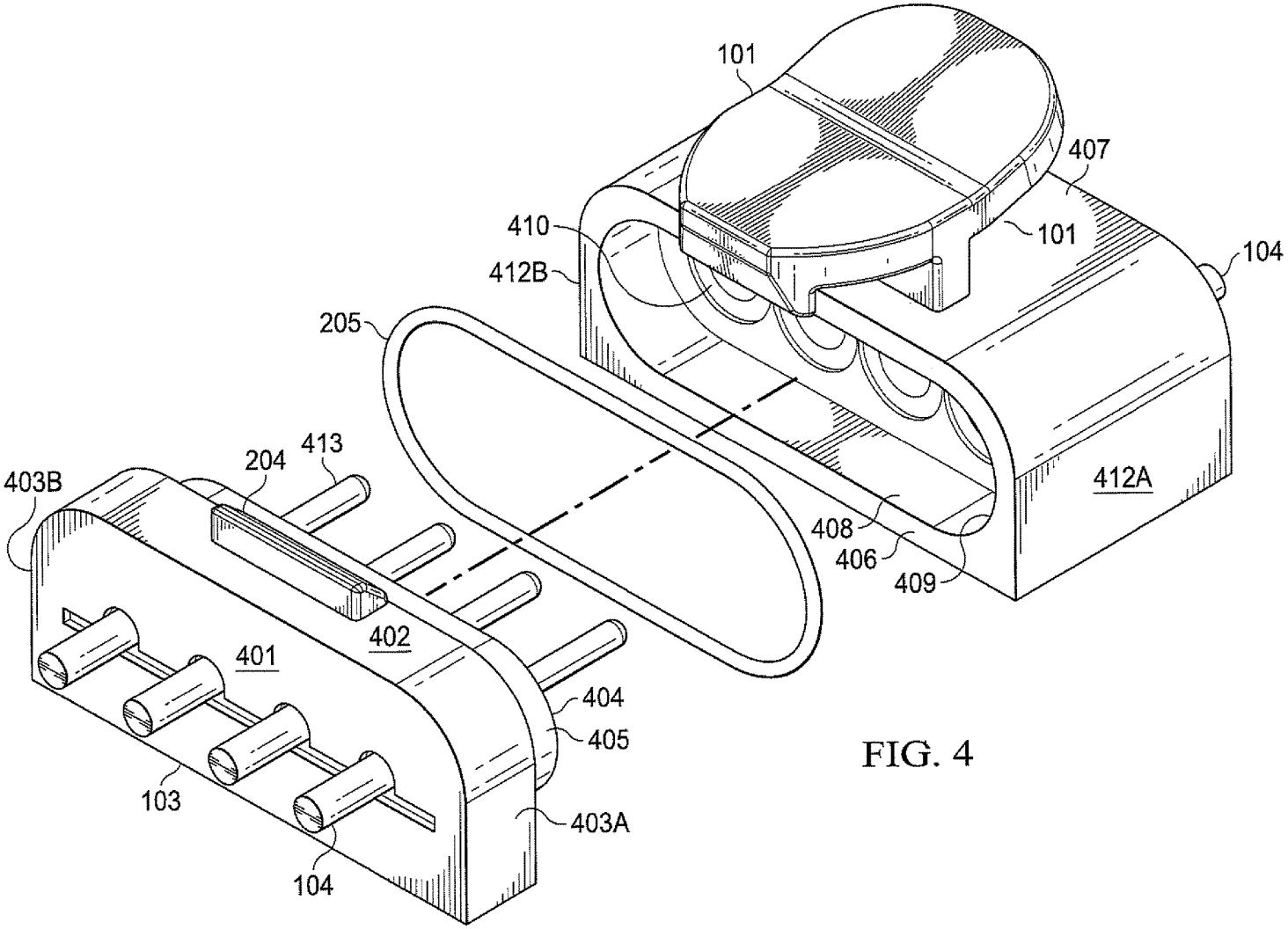
FIG. 4 is a perspective view of a strip connector in accordance with the present invention in a disconnected configuration.
Figure 5:
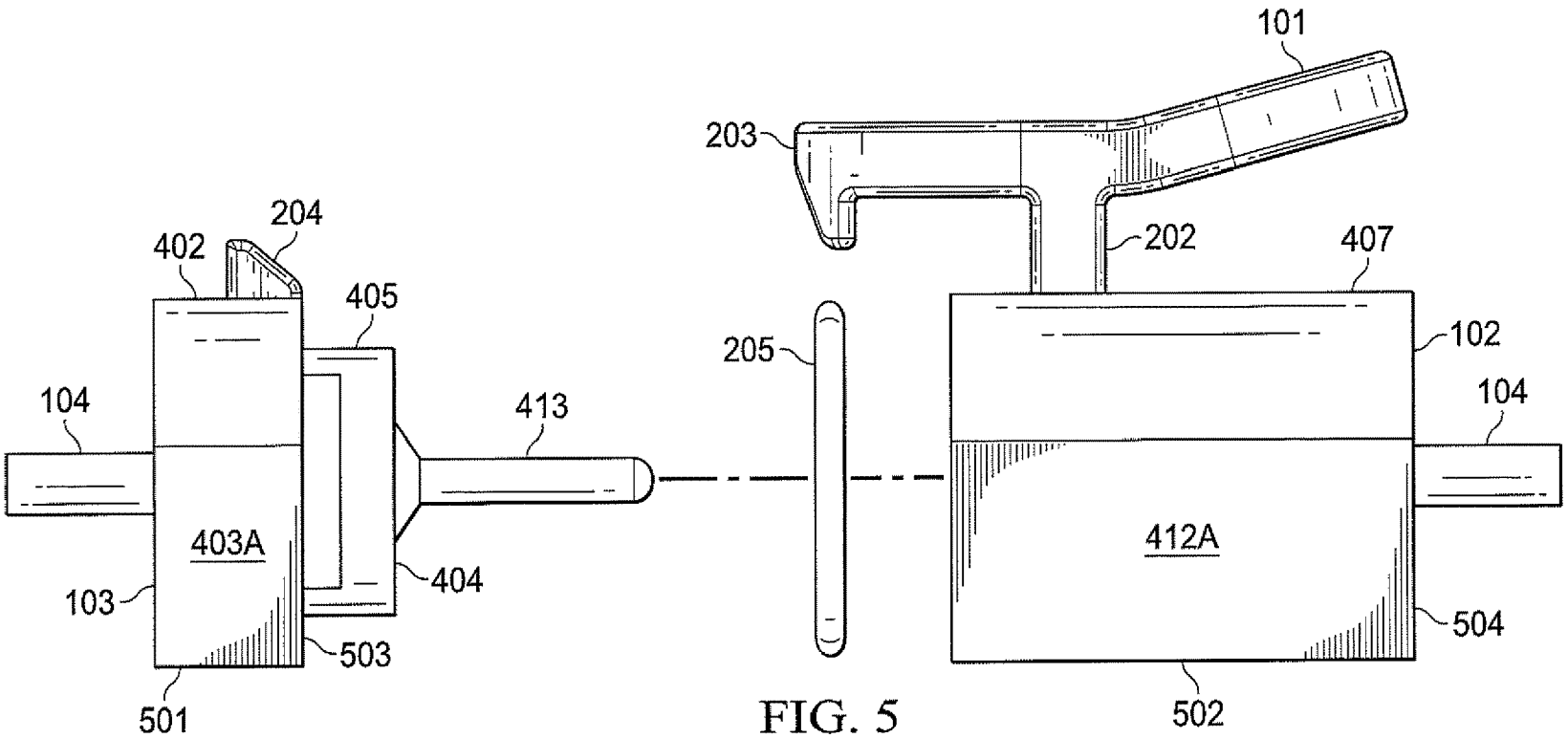
FIG. 5 is a side elevational view thereof.
Figure 6:
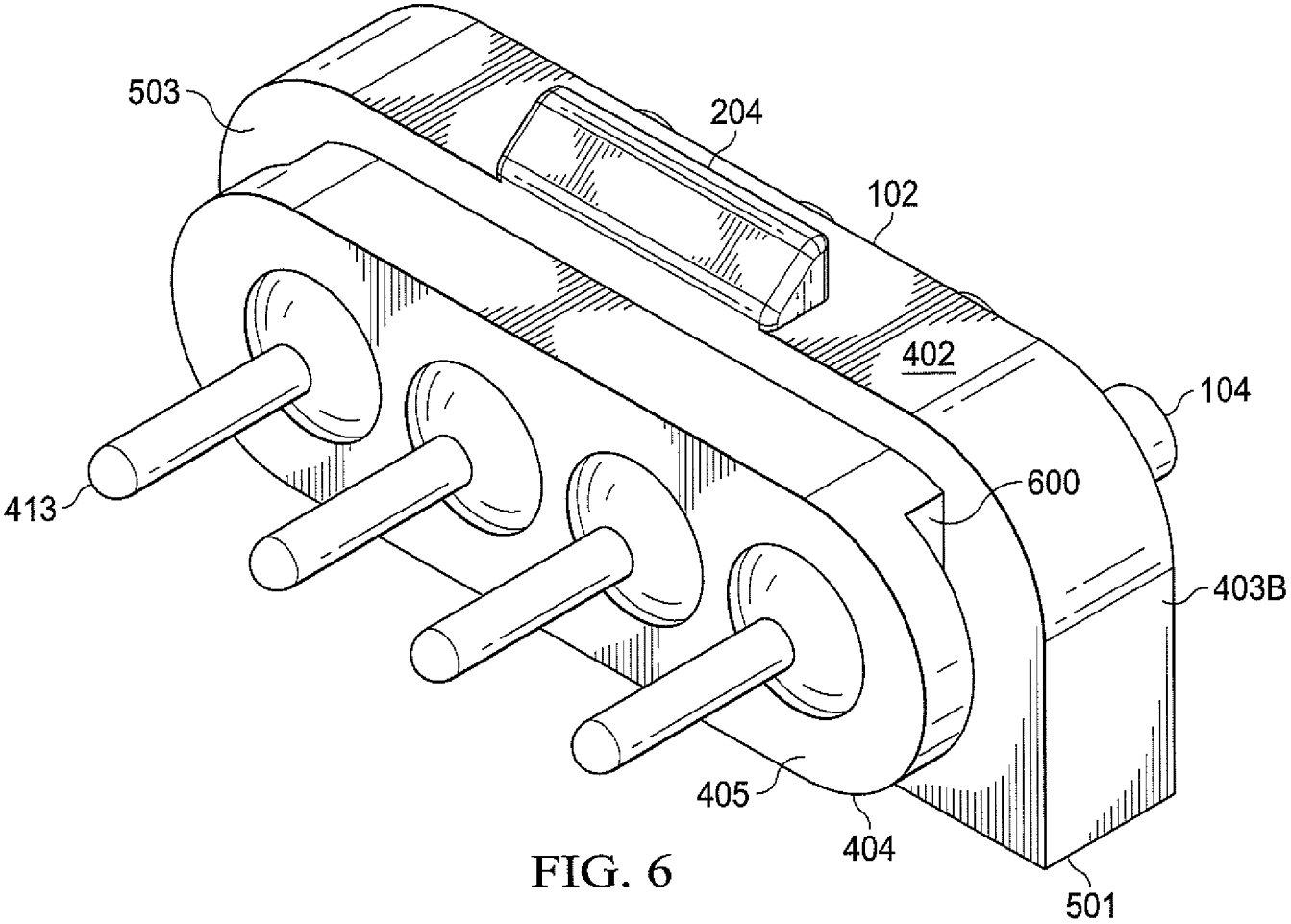
FIG. 6 is a front perspective view of a strip connector male socket in accordance with the present invention.

Referring to FIG. 5, the male socket connection interface 404 of the preferred embodiment comprises four prongs 413, said prongs being made of a conductive material, and extending from shaped extrusion 405, said shaped extrusion 405 being a rectangular prism having its lateral upper and lower edges rounded, and extruding from front face 503 of the male socket 103, said extrusion 405 further having two lock grooves 600 cut into its base. Referring to FIG. 4, said male connection interface 404 corresponds to a female socket connection interface 408 which is configured to receive said male socket connection interface 404. Said female socket connection interface 408 comprises four apertures 410, said apertures being set into shaped recess 409, said shaped recess being configured to receive shaped extrusion 405 and being located in female front face 406 of female socket 102. Moreover, referring to FIG. 4, gasket 205 is seated around the base of shaped extrusion 405 and held in place by said lock grooves 600 such that said gasket is compressed between said male and female sockets when such are connected, thereby forming a continuous impermeable seal between said male and female sockets.

Referring to FIG. 1, said male and female sockets further comprise electrical contacts 104 extending from said male rear face and said female rear face, respectively, said contacts being attached or incorporated into LED strips or connected to wiring.

Figure 7:
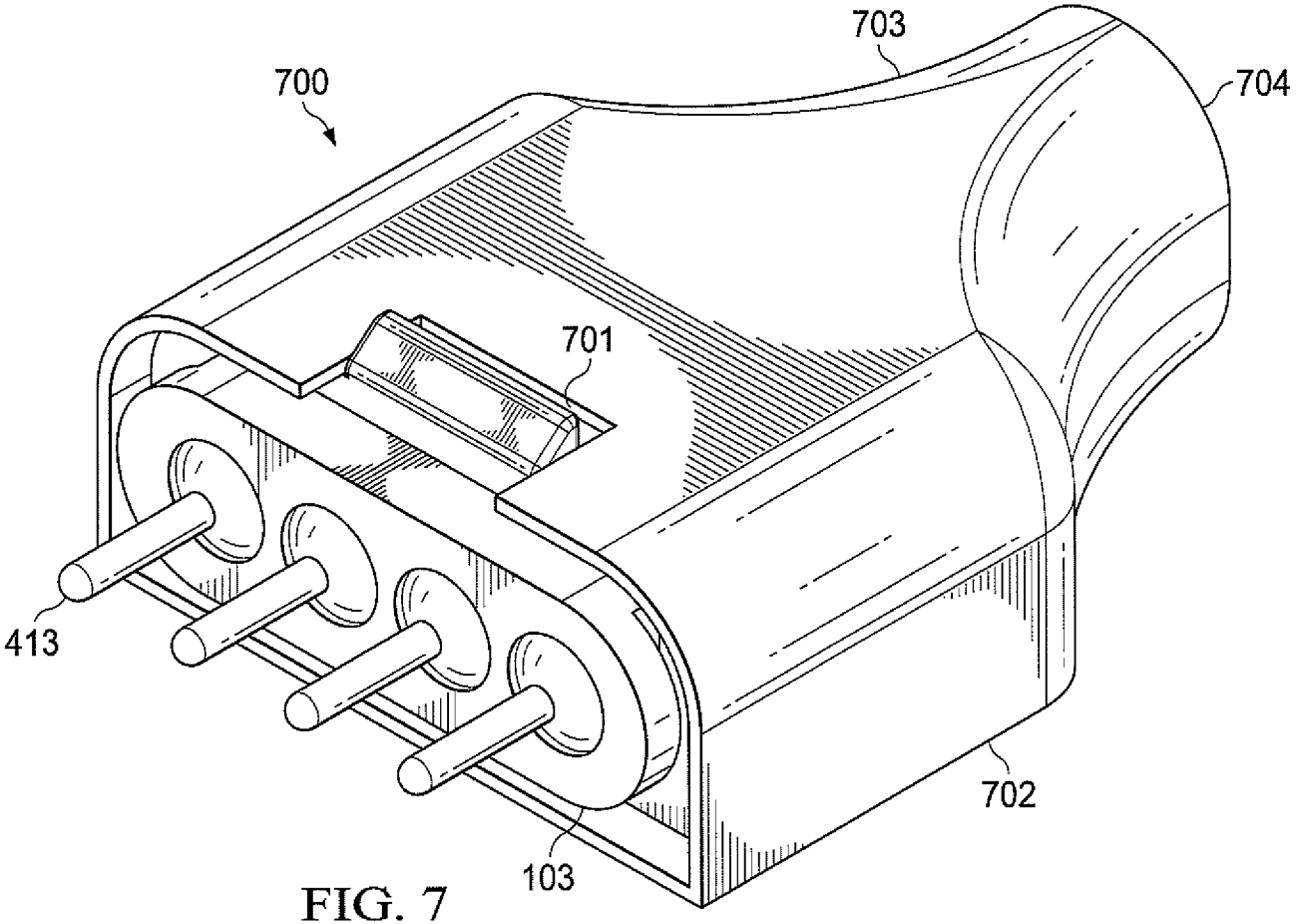
FIG. 7 is a front perspective view of a wired housing and attached/associated male socket, both in accordance with the present invention.
Figure 8:
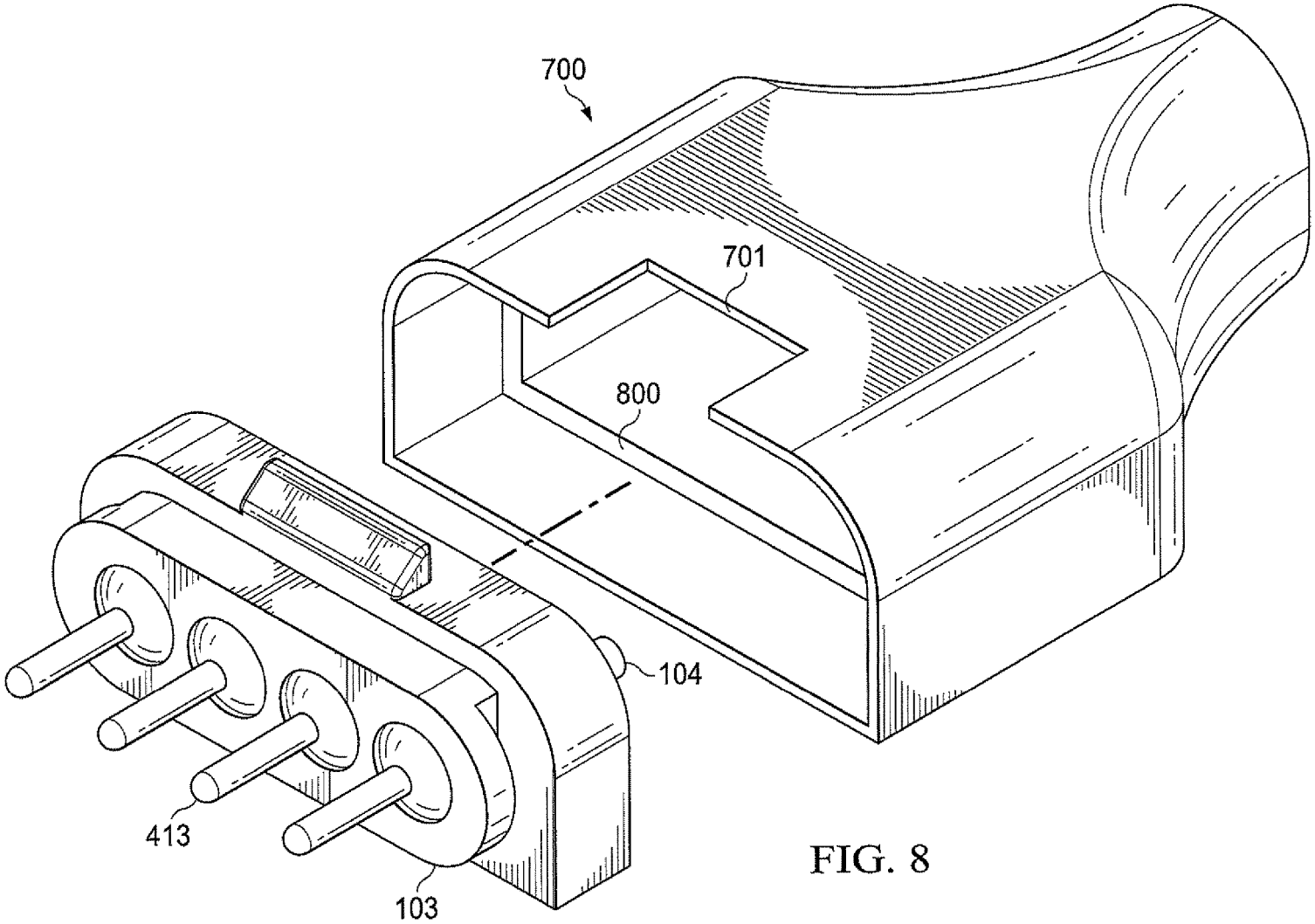
FIG. 8 is a front perspective view of a wired housing in accordance with the present invention and an associated male socket in accordance with the present invention in a detached configuration.
Figure 10:
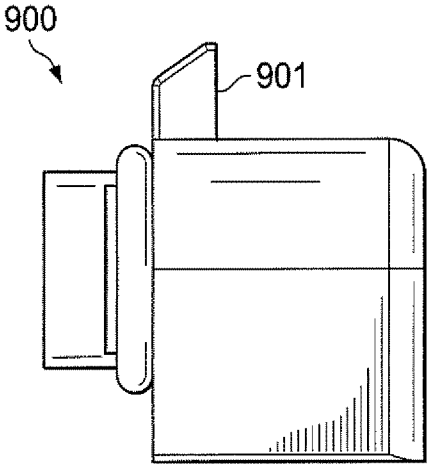
FIG. 10 is a side elevational view thereof.

Referring to FIG. 7 and FIG. 8, in the preferred embodiment, a wired housing 700 consists of a forward section 702 comprising a thin-walled rectangular prism having its upper lateral edges filleted and being open along the longitudinal axis of said wired housing, and having internally a ledge 800 set back from its forward opening thereby positioning an inserted male socket 103 such that a female socket can be securely mated thereto, said forward section additionally comprising a notch 701 on its upper surface sized to admit a clip catch 204 extending from the upper surface of said male socket, said forward section being thus configured to receive a male socket; said male socket being oriented such that the connection interface thereof is facing outward, said male socket further being tightly seated or fixed in place inside said wired housing by, e.g., an adhesive such that electrical connections within said wired housing are not exposed to the environment; said wired housing 700 further comprising a rearward section 703 being open along the longitudinal axis of said wired housing and having an opening 704 whereby wires supplying electrical power can be admitted to the interior of said wired housing and connected to the contacts 104 extending from the rear face of said male socket, said rearward opening being narrower than said forward opening, said forward section 702 transitioning to said rearward section 703 at an intermediate point along the longitudinal axis of said wired housing, said rearward section further being smoothly tapered from said intermediate point to said narrow rearward opening;

Referring to FIG. 9, in the preferred embodiment, an end cap 900 comprises a housing being made of a dielectric material and having a front face defined as facing the connection interface 408 of an associated female socket 102, a rear face opposite said front face, and an upper surface adjacent to the upper surface of said female socket; said end cap upper surface having a clip catch 901 extending therefrom; said end cap front face having a subsection 902 extruded from said face, said extrusion 902 being a rectangular prism having its lateral upper and lower edges rounded, and having two lock grooves 1100 cut into its base and a rectangular slot 903 set into its forwardmost face; said extrusion 902 being thus configured to be received by a female socket connection interface 408, thereby preventing exposure of female electrical contacts 410 to the environment.

Figure 2:
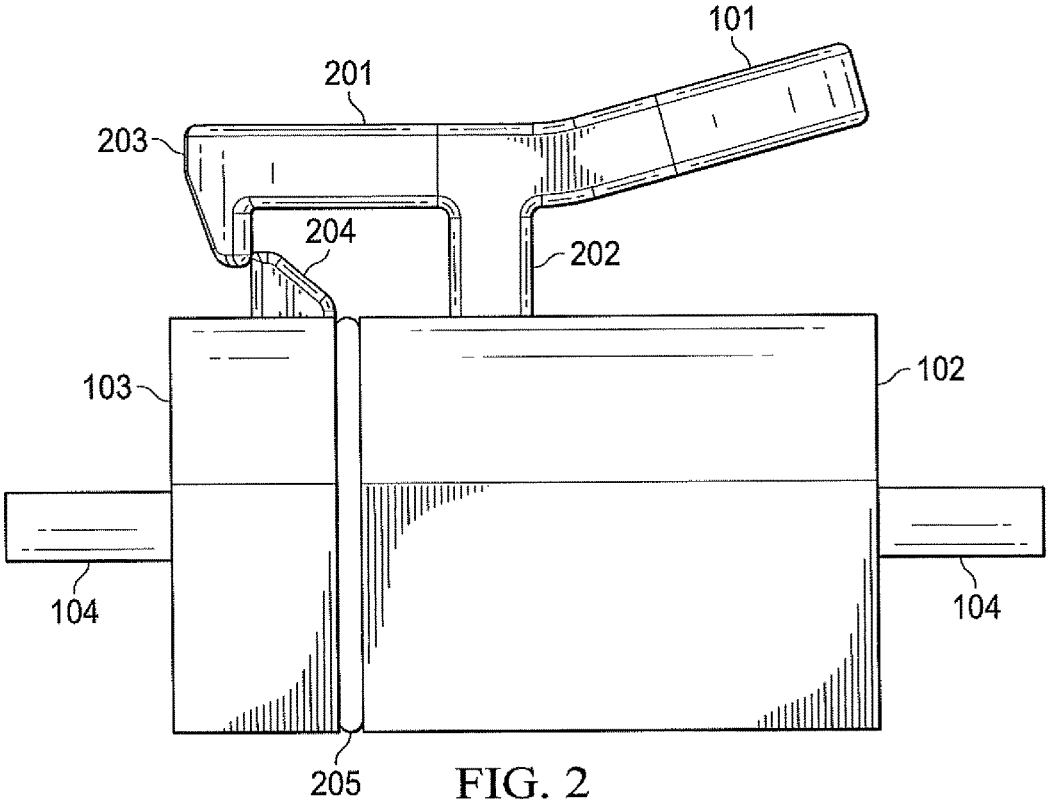
FIG. 2 is a side elevational view thereof.
Figure 3:
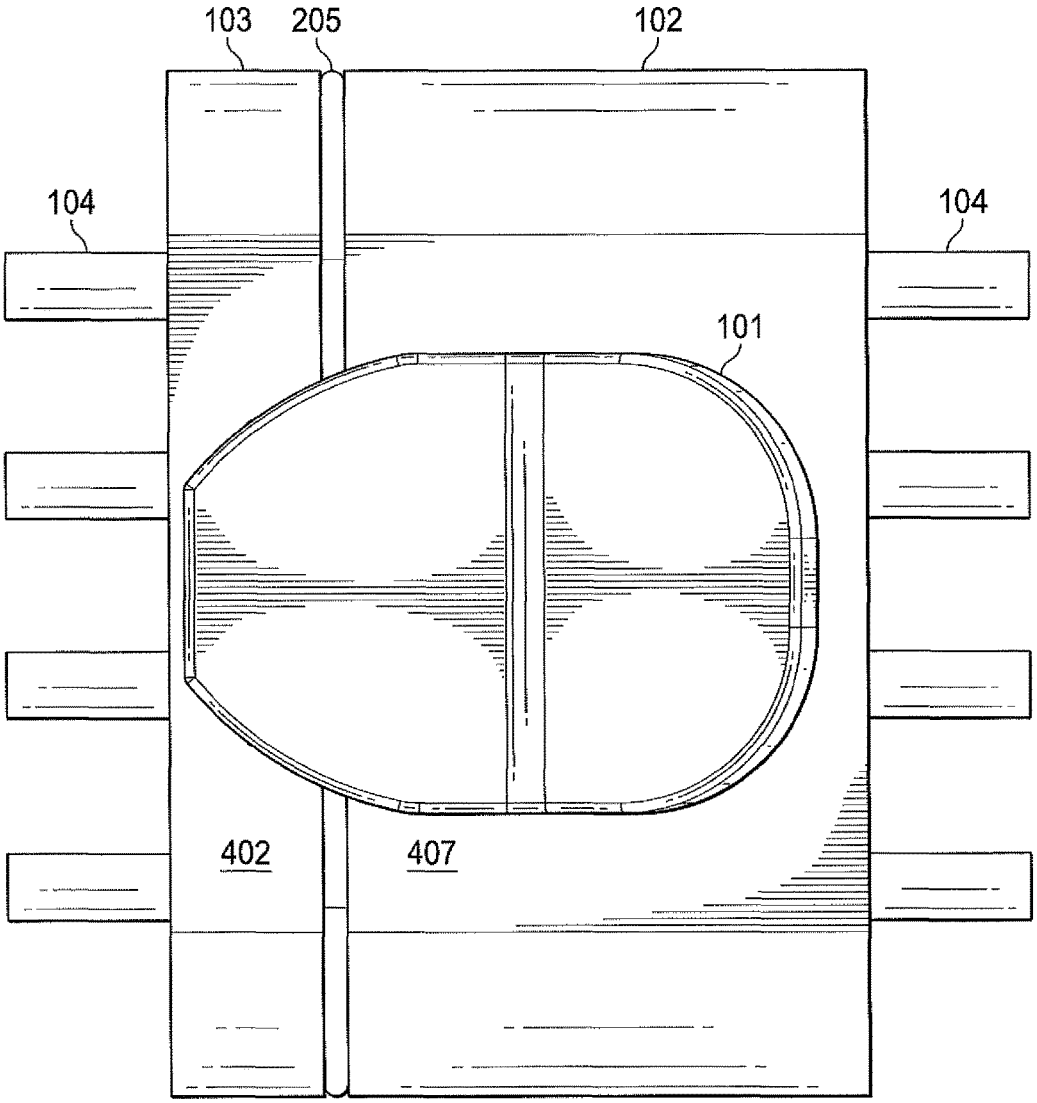
FIG. 3 is top plan view thereof.

To assemble the LED strip connector, referring to FIG. 4, orient male socket 103 and female socket 102 such that front face 503 of male socket 103 is facing front face 406 of female socket 102. Further, upper surface 402 of male socket 103 containing clip catch 204 (being a ridge or a recessed notch) should be adjacent to upper surface 407 of female socket 102 containing clip arm 201, clip pivot point 202 and clip arm lip 203. Gasket 205 is positioned around the base of shaped extrusion 405 and seated in lock grooves 600 such that it forms a seal between male and female sockets when such are connected. Referring to FIG. 2, male socket 103 is mated to female socket 102 such that the locking mechanism 101 engages and locks. Locking mechanism 101 is engaged when clip arm lip 203 has moved over and behind clip catch 204. One unengaged female socket 102 is then connected to a wired housing 700 by the associated male socket connection interface and interposed gasket, thereby powering the LED strip. An exposed female socket connection interface is then connected to an end cap. In a further embodiment, the end cap has a lock lever with a clip arm lip to catch a clip catch.

The invention further comprises a connector having a male socket and a second socket connecting a first string of electronic elements to a second string of electronic elements. The male socket is adapted to be coupled to a first string of electronic elements, the male socket further comprising a housing having a cuboid shape and being made of an insulated or dielectric material, defining a front face as facing said female socket, a rear face opposite said front face, and upper and lower surfaces between said front and rear faces; a male connection interface being located on said male socket front face and comprising an extruded subsection of said front face and four prongs extending from said extrusion arranged linearly, said prongs being made of a conductive material; and a locking mechanism notch or ridge within or on said male socket upper surface, said notch or ridge for receiving a locking mechanism clip arm lip extending from the locking mechanism clip arm.

The female socket is coupled to a second string of electronic elements wherein said female socket further comprises a housing having a cuboid shape and being made of an insulated or dielectric material, defining a front face as facing said male socket front face, a rear face opposite said female socket front face, and upper and lower surfaces between said female socket front face and female socket rear face, and a female connection interface being located on said female socket front face and comprising a recessed subsection of said female socket front face and four apertures arranged linearly, said apertures being within said recessed subsection. The female connection interface is configured to receive said male connection interface.

The locking mechanism clip arm is flexibly coupled in a generally orthogonal position to a locking mechanism clip pivot point extending from said female socket housing upper surface, the locking mechanism clip arm having on an end thereof proximate the male socket a clip arm lip configured to catch the locking mechanism notch or ridge such that, when caught, said male socket and said female socket are thus secured when mated. A gasket is adapted to be disposed between the male socket and the female socket.

In an embodiment, the first string of electronic elements is a strip of light emitting diodes (LEDs). In a further embodiment, the second string of electronic elements is a strip of light emitting diodes (LEDs). In a further embodiment, either the first string or the second string of electronic elements is a power cord. The gasket is configured and positioned such that it provides a seal between the male socket and the female socket and is made of an elastic impermeable material. The gasket can be made of a material selected from the group consisting of rubber, silicone, plastic polymer, and other suitable elastomer.

In an embodiment, the male socket prongs have a length of between 2 millimeters and 6 millimeters, preferably between 3.5 millimeters and 4.5 millimeters and the distance between the rear face of the male socket and the rear face of the female socket is between 5 millimeters and 12 millimeters when said male socket and said female socket are mated, preferably the distance between the rear face of the male socket and the rear face of the female socket is between 8 millimeters and 9 millimeters when said male socket and said female socket are mated.

The embodiments shown and described above are only exemplary. Even though numerous characteristics and advantages of the present invention have been set forth in the foregoing description together with details of the connectors of the present invention, the disclosure is illustrative only and changes may be made within the principles of the invention to the full extent indicated by the broad general meaning of the terms used herein. Various alterations, modifications and substitutions can be made to the disclosed invention without departing in any way from the spirit and scope of the invention.

What is claimed is:

1. An apparatus for coupling light emitting diode (LED) strips to each other or to a power source, comprising:

a male socket;

a female socket;

a locking mechanism catch located on an upper surface of the male socket;

a locking mechanism clip arm located on the upper surface of the female socket, the locking mechanism clip arm and locking mechanism catch, when engaged, adapted to securely couple the male socket to the female socket;

a gasket disposed between one of the male socket or the female socket, wherein such gasket is made of an elastic impermeable material;

a wired housing adapted to receive the male socket, the wired housing comprising:

a housing being made of a dielectric or insulating material, defining a front face as facing said female socket, a rear face opposite said front face, and an upper surface adjacent to the upper surface of said female socket, and being divided into a forward section and a rearward section; said forward section having a cuboid shape and being joined to said rearward section at an intermediate point, and said rearward section having on its rear face a narrow opening and being smoothly tapered between said intermediate point and said narrow opening;

a wired housing male connection interface located on said forward section front face and comprising an extruded subsection of said front face for receiving the male socket wherein the four prongs of the male socket extend from said extrusion; and a notch within the housing dimensioned to receive the male socket locking mechanism catch.

2. The apparatus in accordance with claim 1, further comprising an end cap, the end cap comprising:

a housing having a cuboid shape and being made of an insulated or dielectric material, defining a front face as facing said female socket, a rear face opposite said front face, and upper and lower surfaces between said front and rear faces; and an end cap connection interface being located on said end cap front face and comprising an extruded subsection of said front face, said extruded subsection having a slot set therein, said slot having a rectangular shape.

3. The apparatus in accordance with claim 2, further comprising a locking mechanism catch being a notch or ridge within or on said end cap upper surface, said catch for receiving a locking mechanism clip arm lip extending from the locking mechanism clip arm.

4. The apparatus in accordance with claim 1 wherein said male socket comprises:

a housing having a cuboid shape and being made of an insulated or dielectric material, defining a front face as facing said female socket, a rear face opposite said front face, and upper and lower surfaces between said front and rear faces;

a male connection interface being located on said male socket front face and comprising an extruded subsection of said front face and four prongs extending from said extrusion arranged linearly, said prongs being made of a conductive material; and the locking mechanism catch being a notch or ridge integrated on said male socket upper surface, said locking mechanism catch for receiving a lip extending downward from the locking mechanism clip arm of the female socket.

5. The apparatus in accordance with claim 1 wherein said female socket comprises:

a housing having a cuboid shape and being made of an insulated or dielectric material, defining a front face as facing said male socket front face, a rear face opposite said female socket front face, and upper and lower surfaces between said female socket front face and female socket rear face;

a female connection interface being located on said female socket front face and comprising a recessed subsection of said female socket front face and four apertures arranged linearly; said apertures being within said recessed subsection; said female connection interface being configured to receive said male connection interface; and said locking mechanism clip arm being flexibly coupled in a generally orthogonal position to a locking mechanism clip pivot point extending from said female socket housing upper surface, the locking mechanism clip arm having on an end thereof proximate the male socket, a clip arm lip configured to engage the locking mechanism catch, and when engaged, said male socket and said female socket being secured when mated.

6. The apparatus in accordance with claim 5 wherein said prongs have a length of between 2 millimeters and 6 millimeters.

7. The apparatus in accordance with claim 1 wherein the distance between a rear face of the male socket and a rear face of the female socket is in the range 5 millimeters and 12 millimeters when said male socket and said female socket are mated.

8. The apparatus in accordance with claim 1 wherein said gasket is configured and positioned such that it provides a seal between the male socket and the female socket.

9. The apparatus in accordance with claim 8 wherein said gasket is made of rubber.

10. The apparatus in accordance with claim 9 wherein said gasket is made of a material selected from the group consisting of silicone and plastic polymer.

11. An apparatus for coupling light emitting diode (LED) strips to each other or to a power source, comprising:

a male socket;

a female socket;

a locking mechanism catch located on an upper surface of the male socket;

a locking mechanism clip arm located on the upper surface of the female socket, the locking mechanism clip arm and locking mechanism catch, when engaged, adapted to securely couple the male socket to the female socket;

a gasket disposed between one of the male socket or the female socket;

an end cap, the end cap comprising:

a housing having a cuboid shape and being made of an insulated or dielectric material, defining a front face as facing said female socket, a rear face opposite said front face, and upper and lower surfaces between said front and rear faces;

an end cap connection interface being located on said end cap front face and comprising an extruded subsection of said front face, said extruded subsection having a slot set therein, said slot having a rectangular shape; and a locking mechanism catch being a notch or ridge within or on said end cap upper surface, said catch for receiving a locking mechanism clip arm lip extending from the locking mechanism clip arm.

12. The apparatus in accordance with claim 11 wherein said gasket is configured and positioned such that it provides a seal between the male socket and the female socket.

13. The apparatus in accordance with claim 12 wherein said gasket is made of an elastic impermeable material.

14. The apparatus in accordance with claim 13 wherein said gasket is made of rubber.

15. The apparatus in accordance with claim 13 wherein said gasket is made of silicone.

16. The apparatus in accordance with claim 13 wherein said gasket is made of a plastic polymer.

17. An apparatus for coupling light emitting diode (LED) strips to each other or to a power source, comprising:

a male socket;

a female socket;

a locking mechanism catch located on an upper surface of the male socket;

a locking mechanism clip arm located on the upper surface of the female socket, the locking mechanism clip arm and locking mechanism catch, when engaged, adapted to securely couple the male socket to the female socket;

a gasket disposed between one of the male socket or the female socket;

an end cap, the end cap comprising:

a housing having a cuboid shape and being made of an insulated or dielectric material, defining a front face as facing said female socket, a rear face opposite said front face, and upper and lower surfaces between said front and rear faces;

an end cap connection interface being located on said end cap front face and comprising an extruded subsection of said front face, said extruded subsection having a slot set therein, said slot having a rectangular shape; and a locking mechanism catch being a notch or ridge within or on said end cap upper surface, said catch for receiving a locking mechanism clip arm lip extending from the locking mechanism clip arm;

wherein said male socket comprises:

a housing having a cuboid shape and being made of an insulated or dielectric material, defining a front face as facing said female socket, a rear face opposite said front face, and upper and lower surfaces between said front and rear faces;

a male connection interface being located on said male socket front face and comprising an extruded subsection of said front face and four prongs extending from said extrusion arranged linearly, said prongs being made of a conductive material; and the locking mechanism catch being a notch or ridge integrated on said male socket upper surface, said locking mechanism catch for receiving a lip extending downward from the locking mechanism clip arm of the female socket; and wherein said female socket comprises:

a housing having a cuboid shape and being made of an insulated or dielectric material, defining a front face as facing said male socket front face, a rear face opposite said female socket front face, and upper and lower surfaces between said female socket front face and female socket rear face;

a female connection interface being located on said female socket front face and comprising a recessed subsection of said female socket front face and four apertures arranged linearly; said apertures being within said recessed subsection; said female connection interface being configured to receive said male connection interface; and said locking mechanism clip arm being flexibly coupled in a generally orthogonal position to a locking mechanism clip pivot point extending from said female socket housing upper surface, the locking mechanism clip arm having on an end thereof proximate the male socket, a clip arm lip configured to engage the locking mechanism catch, and when engaged, said male socket and said female socket being secured when mated.

18. The apparatus in accordance with claim 17 wherein said prongs have a length of between 2 millimeters and 6 millimeters.

19. The apparatus in accordance with claim 18 wherein the distance between a rear face of the male socket and a rear face of the female socket is in the range 5 millimeters and 12 millimeters when said male socket and said female socket are mated.

* * * * *